US010662642B2

(12) United States Patent
Hansort

(10) Patent No.: US 10,662,642 B2
(45) Date of Patent: May 26, 2020

(54) FLOOR DOWEL SLEEVE WITH INTEGRAL SPACING CHAMBERS

(71) Applicant: Midwest Concrete & Masonry Supply, Inc., Naperville, IL (US)

(72) Inventor: Marinus Hansort, St. Pete Beach, FL (US)

(73) Assignee: Midwest Concrete & Masonry Supply, Inc., Naperville, IL (US)

( * ) Notice: Subject to any disclaimer, the term of this patent is extended or adjusted under 35 U.S.C. 154(b) by 0 days.

(21) Appl. No.: 16/365,887

(22) Filed: Mar. 27, 2019

(65) Prior Publication Data

US 2019/0301153 A1 Oct. 3, 2019

Related U.S. Application Data

(60) Provisional application No. 62/651,793, filed on Apr. 3, 2018.

(51) Int. Cl.
*E04B 1/41* (2006.01)
*E04B 1/48* (2006.01)
(Continued)

(52) U.S. Cl.
CPC ..... *E04B 1/4114* (2013.01); *E04B 1/483* (2013.01); *E04B 5/023* (2013.01); *E04B 5/32* (2013.01);
(Continued)

(58) Field of Classification Search
CPC ..... E01C 11/14; E04B 1/48; E04B 1/4114; E04B 5/023; E04B 1/483;
(Continued)

(56) References Cited

U.S. PATENT DOCUMENTS 2,093,697 A * 9/1937 Scholer ..... E01C 11/14 404/62
2,096,702 A 10/1937 Yeoman
(Continued)

FOREIGN PATENT DOCUMENTS

EP 1389648 B1 1/2007

OTHER PUBLICATIONS

PNA Construction Technologies, Inc., Diamond Dowel System, Jan. 2010.

(Continued)

*Primary Examiner* — Brent W Herring
(74) *Attorney, Agent, or Firm* — Honigman LLP

(57) ABSTRACT

A floor dowel sleeve has a body portion with a top wall, a bottom wall, two side walls, and an end wall that together to surround an interior cavity. The interior cavity is configured to receive a dowel plate at an opening in the body portion opposite the end wall. Spacing elements are disposed at each of the two side walls and are configured to interface with opposing edges of the dowel plate to provide a space between the dowel plate and interior surfaces of the two side walls. The spacing elements each have a pair of legs that integrally protrude from the side wall into the interior cavity and interconnect to form a spacing chamber. The spacing elements are each configured to flex into the spacing chamber upon lateral horizontal movement of the dowel plate within the interior cavity.

18 Claims, 6 Drawing Sheets

(51) Int. Cl.
*E04B 5/02* (2006.01)
*E04B 5/32* (2006.01)

(52) U.S. Cl.
CPC ..... *E04B 2005/324* (2013.01); *E04B 2103/02* (2013.01)

(58) Field of Classification Search
CPC .. E04B 2005/324; E04B 5/32; E04B 2103/02; E04B 2005/176; E04C 5/163
USPC ..... 52/396.06, 396.05, 396.04, 396.03, 52/396.02, 393, 378, 379, 258, 259, 260; 404/58, 60
See application file for complete search history.

(56) References Cited

U.S. PATENT DOCUMENTS 2,181,005 A * 11/1939 Westcott ..... E01C 11/14 404/60
2,194,718 A 3/1940 Older
2,305,979 A 12/1942 Mitchell
2,476,243 A 7/1949 Heltzel
3,559,541 A 2/1971 Watstein
4,882,821 A * 11/1989 Sims, Jr. ..... A61G 17/02 27/17
5,005,331 A 4/1991 Shaw et al.
5,216,862 A 6/1993 Shaw et al.
5,344,251 A 9/1994 Erb
5,618,125 A 4/1997 McPhee et al.
5,674,028 A * 10/1997 Norin ..... E01C 11/14 404/60
5,678,952 A 10/1997 Shaw et al.
5,713,174 A 2/1998 Kramer
5,797,231 A 8/1998 Kramer
5,934,821 A 8/1999 Shaw et al.
5,941,045 A 8/1999 Plehanoff et al.
D419,700 S 1/2000 Shaw et al.
6,145,262 A * 11/2000 Schrader ..... E01C 11/14 404/52
6,354,760 B1 3/2002 Boxall et al.
D459,205 S 6/2002 Shaw et al.
6,502,359 B1 1/2003 Rambo
6,692,184 B1 2/2004 Kelly et al.
6,758,023 B1 7/2004 Sorkin
6,926,463 B2 8/2005 Shaw et al.
7,004,443 B2 2/2006 Bennett
7,314,333 B2 * 1/2008 Shaw ..... E01C 11/14 404/58
7,338,230 B2 3/2008 Shaw et al.
7,381,008 B2 6/2008 Shaw et al.
7,441,985 B2 * 10/2008 Kelly ..... E01C 11/14 404/56
7,481,031 B2 1/2009 Boxall et al.
7,604,432 B2 10/2009 Shaw et al.
7,736,088 B2 * 6/2010 Boxall ..... E01C 11/14 249/9
7,748,928 B2 * 7/2010 Estes ..... E01C 11/14 404/58
7,967,527 B2 * 6/2011 Estes ..... E01C 11/14 404/58
8,465,222 B1 6/2013 Ghauch et al.
8,672,579 B2 3/2014 Laiho et al.
9,340,969 B1 5/2016 Shaw
10,323,406 B2 * 6/2019 Hansort ..... E04B 1/4114
10,428,518 B2 * 10/2019 Hansort ..... E04B 1/4114
2005/0036835 A1 2/2005 Shaw et al.
2005/0214074 A1 9/2005 Shaw et al.
2006/0140721 A1 6/2006 Shaw et al.
2006/0182496 A1 * 8/2006 Shaw ..... E01C 11/14 404/56
2006/0275078 A1 12/2006 Shaw et al.
2007/0231068 A1 * 10/2007 Francies ..... E01C 11/14 404/56
2007/0269266 A1 * 11/2007 Kelly ..... E01C 11/14 404/56
2008/0014018 A1 * 1/2008 Boxall ..... E01C 11/14 404/56
2008/0267704 A1 * 10/2008 Shaw ..... E01C 11/14 404/58
2009/0035063 A1 * 2/2009 Estes ..... E01C 11/14 404/52
2010/0054858 A1 * 3/2010 Mayo ..... E01C 11/14 404/56
2010/0229474 A1 * 9/2010 Estes ..... E01C 11/14 52/126.1
2010/0313518 A1 12/2010 Berg
2012/0096800 A1 * 4/2012 Berg ..... E04B 1/003 52/588.1
2015/0197898 A1 7/2015 Shaw
2015/0204026 A1 7/2015 McDonald
2016/0083914 A1 3/2016 Shaw
2016/0222600 A1 8/2016 Shaw
2018/0135297 A1 * 5/2018 Parkes ..... E04B 1/4114
2018/0202145 A1 * 7/2018 Hansort ..... E04B 1/4114
2019/0257074 A1 * 8/2019 Hansort ..... E04B 1/483

OTHER PUBLICATIONS

Greenstreak Group, Inc., You have a Choice!, Mar. 2010.
PNA Construction Technologies, Inc, PD3 Basket Assembly, Jan. 2010.
PNA Construction Technologies, Inc., Square Dowel and Clip, Jan. 2010.

* cited by examiner

FLOOR DOWEL SLEEVE WITH INTEGRAL SPACING CHAMBERS

CROSS REFERENCE TO RELATED APPLICATION

This application claims benefit and priority under 35 U.S.C. § 119(e) to U.S. provisional application Ser. No. 62/651,793, filed Apr. 3, 2018, the disclosure of which is hereby incorporated by reference in its entirety.

TECHNICAL FIELD

This disclosure relates generally to concrete floor seam reinforcements, and more particularly relates to a pocket or a sleeve cast at a floor seem to receive a dowel plate or bar.

BACKGROUND

It is relatively common to reinforce the seams between concrete floor slabs to prevent the slabs from heaving relative to each other at the seam under unstable loading conditions or temperature fluctuations. When reinforcement members are cast to extend across a seam between floor slabs, cracking and failure in the concrete may occur at the reinforcement member from horizontal movement between the slabs. To prevent such cracking, pockets or sleeves may be cast in one of the slabs, where plates or bars that extend across seams between concrete slabs and engage inside pockets or sleeves to allow some horizontal movement of the plates or bars.

SUMMARY

The present disclosure provides a floor dowel sleeve assembly with a dowel sleeve that receives a dowel plate that spans between and vertically supports concrete slabs at a seam between the concrete slabs. The floor dowel sleeve includes a body portion that has an interior cavity and exterior retention elements, such as tabs that engage in the cast concrete slab. The interior cavity of the sleeve is configured to receive the dowel plate at an opening in the body portion. Spacing elements are disposed within the interior cavity at side walls of the sleeve and are configured to interface with the dowel plate to provide a space between the dowel plate and the side walls. The spacing elements may each integrally protrude from the side walls into the interior cavity and may each include a spacing chamber between a portion the spacing element that contacts the dowel plate and the interior surface of the side wall. The spacing elements may flex into the spacing chamber upon lateral movement of the dowel plate.

According to one aspect of the present disclosure, a floor dowel sleeve for receiving a dowel plate that spans across a seam between concrete slabs includes a body portion that has a top wall, a bottom wall, two side walls, and an end wall that together to surround an interior cavity. The interior cavity of the body portion is configured to receive a dowel plate at an opening in the body portion opposite the end wall. A plurality of spacing elements are disposed at each of the two side walls and are configured to interface with opposing edges of the dowel plate to provide a space between the opposing edges of the dowel plate and interior surfaces of the two side walls. The spacing elements each have a pair of legs that integrally protrude from the interior surface of one of the two side walls into the interior cavity and interconnect to form a spacing chamber between the pair of legs and the interior surface of the side wall. The spacing elements are each configured to flex into the spacing chamber upon lateral horizontal movement of the dowel plate within the interior cavity.

According to another aspect of the present disclosure, a floor dowel sleeve assembly that spans between and vertically supports concrete slabs at a seam between the concrete slabs includes a rectangular-shaped dowel plate that has a first portion configure to be cast into a first concrete slab. The assembly also includes a rectangular-shaped sleeve that has four side walls and an end wall that together surround a cavity that has an opening at an end opposing the end wall. The sleeve is configured to be cast into a second concrete slab adjacent to and forming a seam with the first concrete slab. A second portion of the dowel plate is disposed in the cavity of the sleeve and interfaces with a plurality of spacing elements that integrally protrude into the cavity from two opposing walls of the four side walls to provide a space between the dowel plate and interior surfaces of the two opposing walls. The spacing elements each have a pair of legs that integrally protrude from the interior surface of one of the two side walls into the interior cavity and interconnect at an apex portion of the respective spacing element to form a spacing chamber between the pair of legs and the interior surface of the respective side wall. The plurality of spacing elements are each configured to flex into the spacing chamber upon lateral horizontal movement of the dowel plate within the cavity.

These and other objects, advantages, purposes, and features of the present disclosure will become apparent upon review of the following specification in conjunction with the drawings.

DETAILED DESCRIPTION

Figure 1:
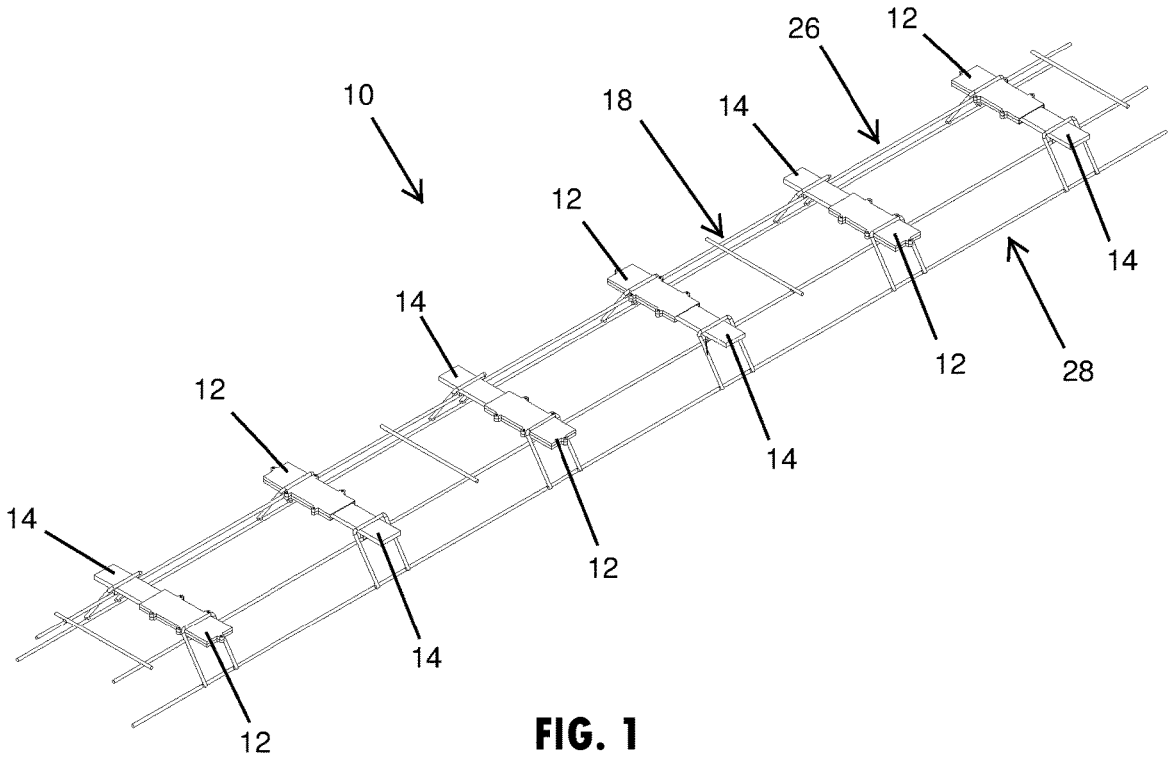
FIG. 1 is a perspective view of floor dowel sleeves attached at a reinforcement structure configured to be cast at a seam between at least two concrete slabs, in accordance with the present disclosure.

Referring now to the drawings and the illustrative embodiments depicted therein, a floor dowel sleeve assembly 10 is provided that includes at least one floor dowel sleeve 12 that receives a dowel plate 14, such as the multiple dowel sleeves 12 and associated dowel plates 14 shown in FIG. 1. The dowel plates 14 are arranged to span between and vertically support adjacent concrete slabs 16*a*, 16*b* at a seam 17 (FIG. 2) between the adjacent concrete slabs 16*a*, 16*b* to generally maintain a vertically flush seam or desired level between the slabs. As shown in FIGS. 1-4, the dowel sleeves 12 and plates 14 may be held in a reinforcement structure 18 that is disposed at and straddling the seam 17 when the adjacent concrete slabs 16*a*, 16*b* are cast, such as to allow the slabs to be poured at the same or nearly the same time. It is also contemplated that the slabs may be separately poured and cast, such that the floor dowel sleeve may be cast at an edge of a concrete slab and the dowel plate may then be inserted in the sleeve to allow an exposed end of the dowel to be cast into the adjacent slab. Likewise, it is contemplated that the dowel plate may be cast at an edge of a concrete slab and the dowel sleeve may be sheathed over the exposed portion of the dowel plate to be cast into the adjacent slab. The dowel sleeves disclosed herein may be arranged in the same slab or different slabs, such as alternating the sleeves 12 in opposing slabs, such as shown in FIGS. 1-4.

The dowel plate 14 may have a substantially rectangular prism shape, such as shown in FIG. 1. A first portion of the dowel plate 14, such as generally a half of the plate, may be cast into one of the concrete slabs, while a second portion of the dowel plate 14, such as a remaining portion or half of the plate, may be received in a rectangular-shaped interior cavity 20 (FIG. 7) of the floor dowel sleeve 12. The sleeve 12 includes spacing elements 22 (FIG. 6) that contact or interface with the dowel plate 14 to provide a space between the dowel plate 14 and the interior side walls of the sleeve 12, such as shown in FIG. 8. The spacing elements 22 protrude into the interior cavity 20 at a generally consistent spacing distance so as to provide a substantially equal spacing on opposing lateral sides of the dowel plate 14. The dowel plate 14 acts to restrict vertical shear forces between the slabs 16*a*, 16*b* (FIG. 2), while allowing horizontal or lateral movement in the sleeve cavity 18, such as due to expansion or contraction of the concrete slabs.

Figure 2:
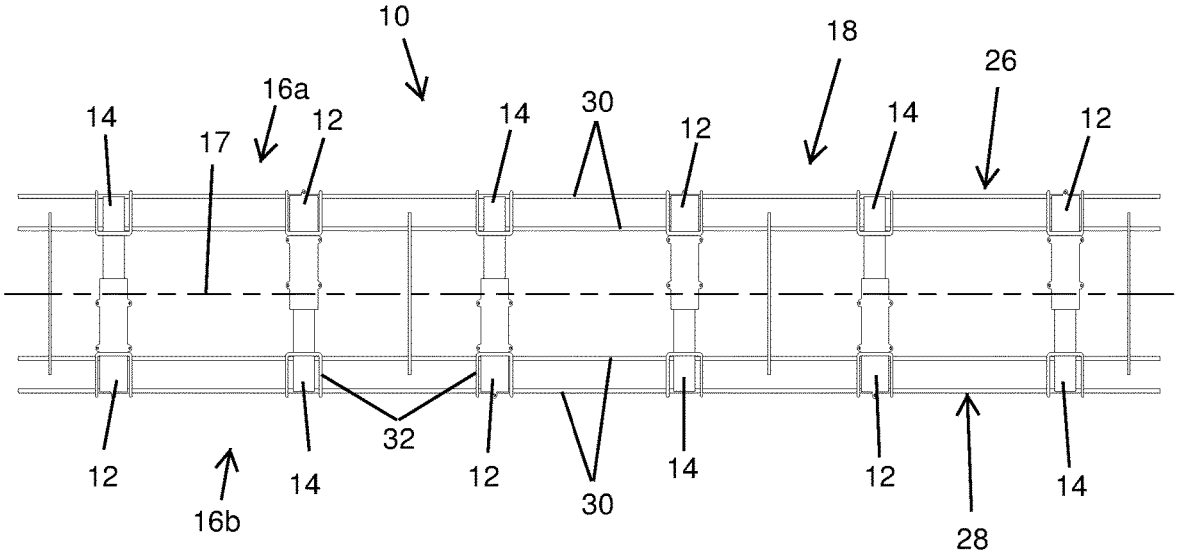
FIG. 2 is a top plan view of the floor dowel sleeves and reinforcement structure cast between two concrete slabs shown in FIG. 1.
Figure 3:
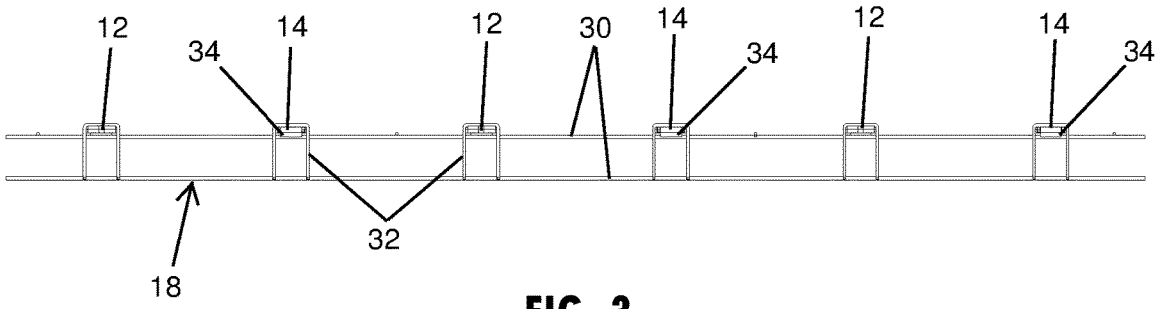
FIG. 3 is an elevation view of the floor dowel sleeves and reinforcement structure cast between two concrete slabs shown in FIG. 1.
Figure 4:
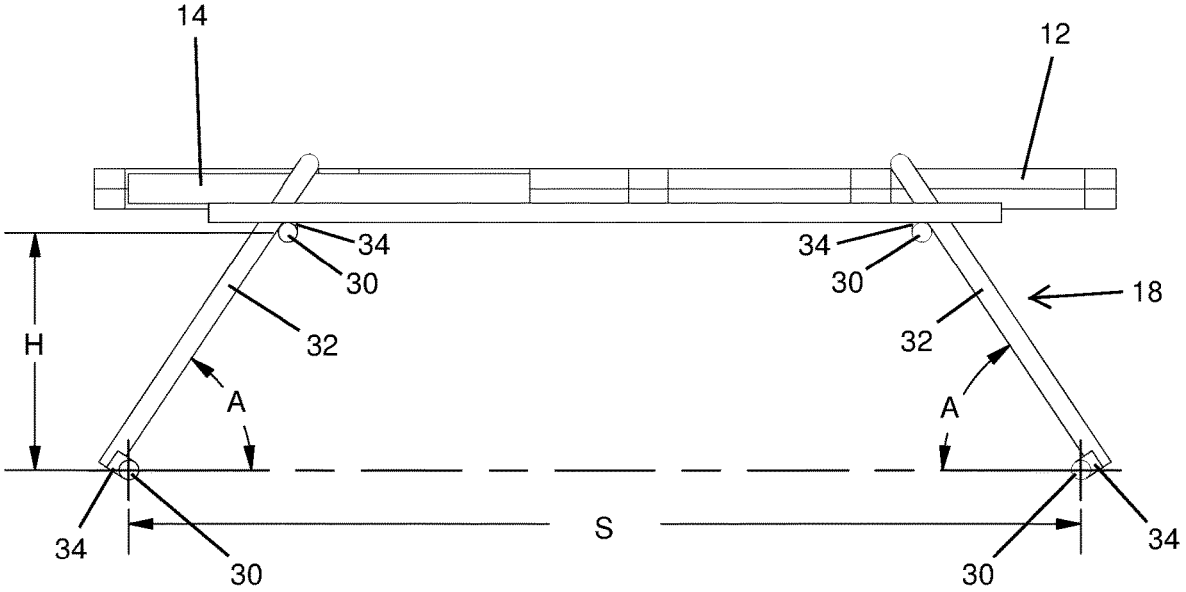
FIG. 4 is another elevation view of the floor dowel sleeves and reinforcement structure cast between two concrete slabs shown in FIG. 1.

As shown in FIGS. 1-4, the reinforcement structure 18 that supports the sleeves 12 and dowel plates 14 away from the floor of the concrete form may include at least two reinforcement sections 26, 28 that are arranged on opposing sides of the seam 17 to be cast in separate concrete slabs 16*a*, 16*b*. The reinforcement sections 26, 28 may be substantially mirror images of each other across the seam 17. As shown in FIG. 2, each reinforcement section may include elongated bars 30 that extend generally parallel to the seam 17 and risers 32 that extend upward from the floor of the concrete form to support the sleeves 12 and dowel plates 14 at an elevation desired for the cast concrete floor structure. As shown in FIG. 4, the risers 32 elevate the sleeves 12 and dowel plates 14 to a height H that is based upon the predetermined depth of the cast concrete slabs or floor, such that the dowel plates 14 span between and are cast in the adjacent slabs at the desired height or depth of the slabs.

To support and horizontally suspended the sleeves 12 and dowel plates 14 in a freestanding manner prior to pouring the concrete, the risers 32 may extend or angle toward the seam 17 at a desired angle A, such as approximately between 50 and 60 degrees as shown in FIG. 4, where the lower ends of the risers 32 may be disposed at a spacing S from each other that generally corresponds with the length of the sleeves 12 the engaged dowel plate 14. The desired angle A may vary in other examples, such as be between 20 and 70 degrees, to correspond with desired height H of the dowel plates away from the floor. The reinforcement structure 18 may also include electric resistance weldments 34 that are attached between portions of the reinforcement structure 18 and connections between the reinforcement structure 18 and the dowel plates 14. The electric resistance weldments 34 may space pieces made of metal away from each other, such as at every wire intersection, such that the resistance weldments 34 may comprise electrically insulating material, such as a fiber glass or polymer or the like. As shown in FIGS. 1-4, the resistance weldments 34 may provide a space between the dowel plates 14 and the elongated bars 30 and between the risers 34 and the elongated bars 30.

Figure 5:
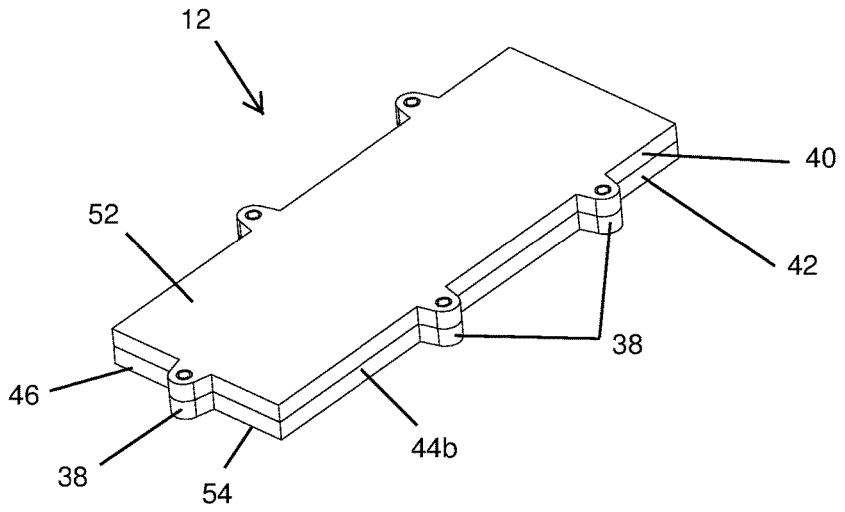
FIG. 5 is a perspective view of a floor dowel sleeve shown in FIG. 4.
Figure 6:
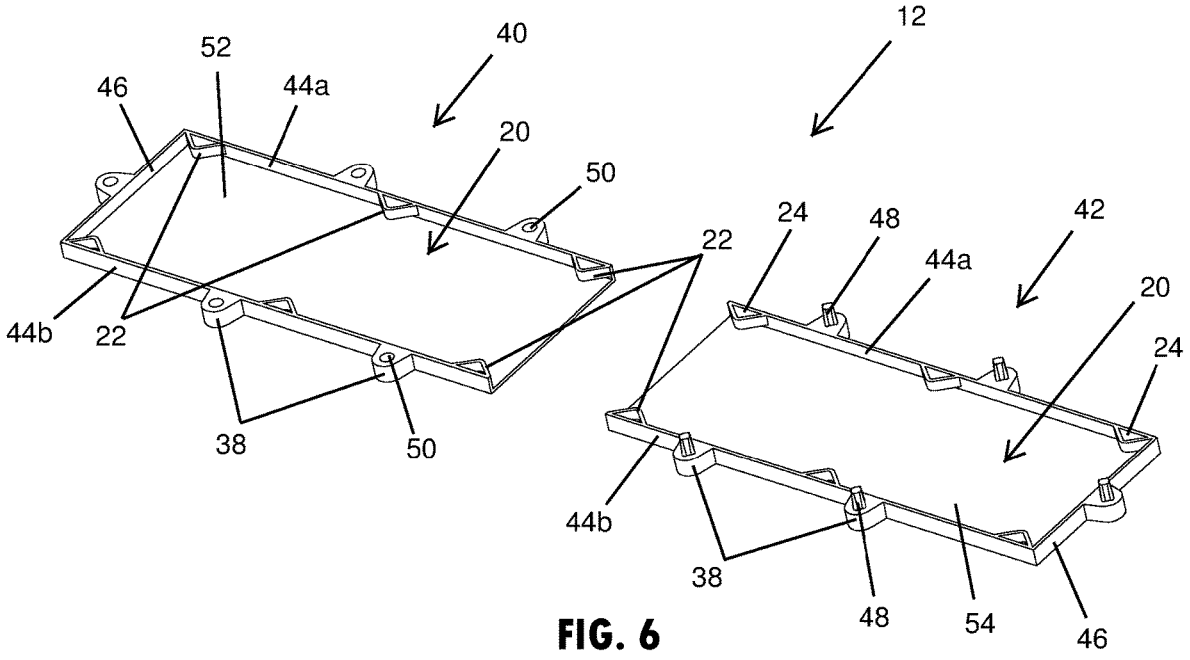
FIG. 6 is a perspective view of the floor dowel sleeve shown in FIG. 5, showing the pieces of the sleeve unassembled and separated from each other.
Figure 7:
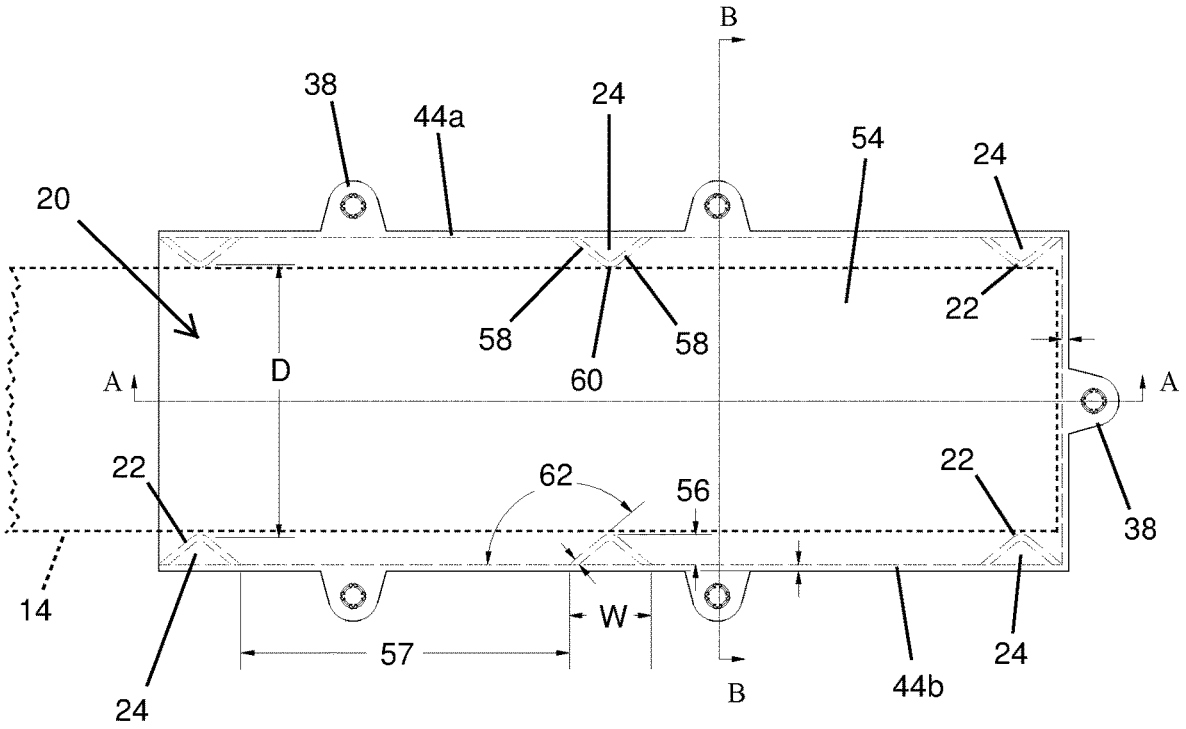
FIG. 7 is a plan view of the floor dowel sleeve shown in FIG. 5, showing the dowel plate and spacing elements in dashed lines.
Figure 8:
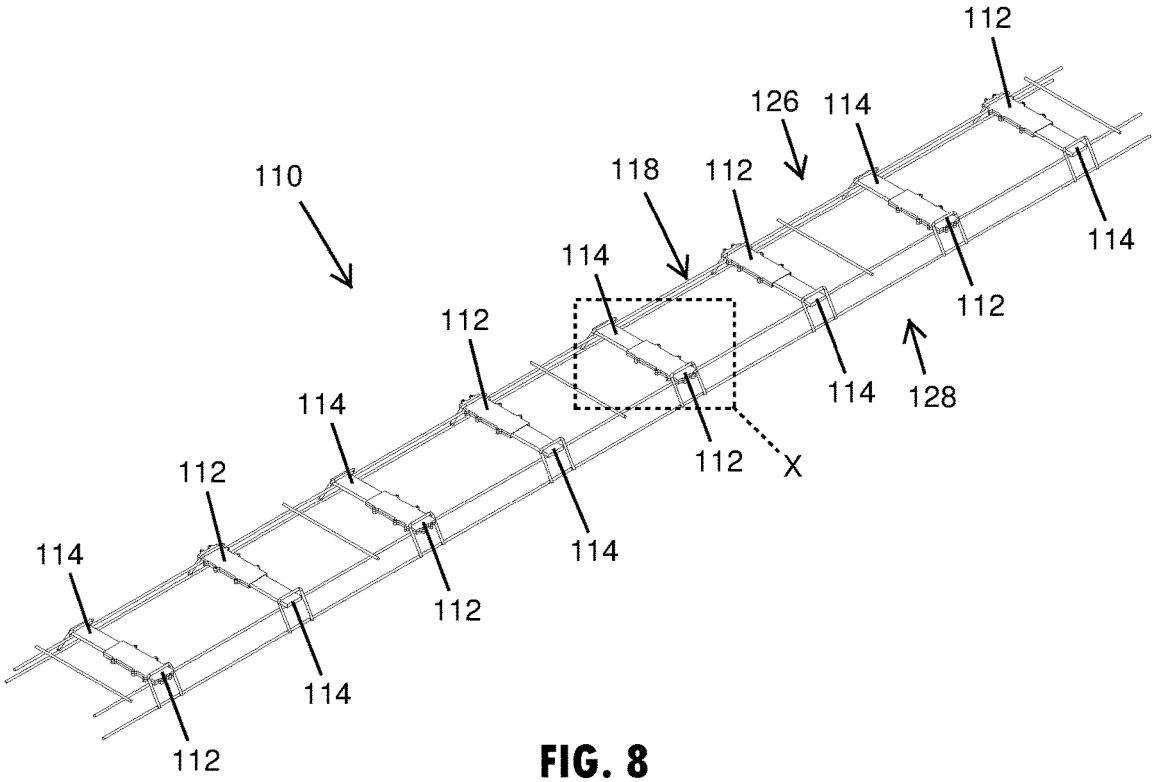
FIG. 8 is a perspective view of another example of floor dowel sleeves attached at a reinforcement structure configured to be cast at a seam between at least two concrete slabs.

The floor dowel sleeve 12, such as shown in FIGS. 5-7, includes a body portion 36 that has exterior retention elements 38, such as tabs that engage in and retain the sleeve 12 in the cast concrete slab. The exterior retention elements 38 may be features separate from the body portion or, as shown in FIGS. 5-7, features that are integral portions of the body portion 36 of the dowel sleeve 12. The retention elements 38 may protrude outward from the sleeve 12, such as horizontally from the side walls 44*a*, 44*b* and the end wall 46 of the body portion 36. It is contemplated that the retention elements may be alternatively shaped or disposed at different portions of the body portion in additional embodiments of the sleeve.

As shown in FIGS. 5-7, the sleeve 12 includes two pieces 40, 42 that attach together to form the sleeve 12. Each piece of the sleeve 12 may be integrally formed with the spacing elements 22 as a single piece. The single piece may be made of one or more materials, such as at least one of a polymer, fiber composite, and metal material. As shown in FIGS. 5-7, the two pieces of the sleeve 12 are injection molded from a plastic material. These top and bottom pieces 40, 42 of the sleeve are configured to attach together prior to being cast in one of the concrete slabs. The sleeve pieces 40, 42 may be attached together with one or more of adhesive, mechanical fasteners, or integral attachment features or the like. As shown in FIG. 6, the retention elements 38 include integral attachment features, provided as pegs 48 and apertures 50 that each matably receive one of the pegs 48, such as in a friction-fit connection. It is also conceivable that in additional embodiments that at least some of the pegs may be replaced with a bolt or other mechanical fastener that extends between the retention elements to hold the sleeve pieces together.

As further shown in FIGS. 5-7, the body portion 36 of the floor dowel sleeve 12 includes a top wall 52 and a bottom wall 54 that, together with the two side walls 44*a*, 44*b* and the end wall 46, surround the interior cavity 20 of the sleeve 12. The two side walls 44*a*, 44*b* are substantially parallel with each other and substantially perpendicular with the top wall 52 and the bottom wall 54. The dowel sleeve 12 receives the dowel plate 14 within or at an opening 18*a* of the cavity 18 opposite the end wall 46. The spacing elements 22 may be disposed at each of the side walls 44*a*, 44*b*, such as shown in FIG. 7 to interface with opposing portions or edges of the dowel plate 14. The spacing elements 22 provide a gap or space 56 between the lateral or outside edges of the dowel plate 14 and interior surfaces of the two side walls 44*a*, 44*b*. It is contemplated that at least two or at least three or between two and five spacing elements may be disposed at each of the side walls, such as the three spacing elements 22 shown in FIG. 7 that are generally equally spaced from each other. As shown in FIG. 7, the spacing elements 22 are spaced from each other at a spacing 57 of approximately four to five times the width W of each spacing element 22.

The spacing elements 22 disclosed herein may each include a spacing chamber 24 that is an enclosed or partially enclosed area or pocket that is void of rigid or incompressible material, such as an area occupied by air. The spacing chamber 24 is disposed between a portion of the spacing element 22 that contacts the dowel plate 14 and the interior surface of the respective side wall 44*a*, 44*b*. The spacing chamber 24 may compress upon lateral movement of the dowel plate 14, such that the spacing chamber 24, in conjunction with the spacing element 22, assists to regulate and maintain the space 56 between the dowel plate 14 and the side walls 44*a*, 44*b*. The spacing elements 22 may each have legs 58 that integrally protrude from the interior surface of one of the side walls 44*a*, 44*b* into the interior cavity 20 and interconnect at an apex portion 60 to define the spacing chamber 24 between the legs 58 and the interior surface of the side wall. The spacing elements 22 are each configured to elastically flex into the spacing chamber 24 upon lateral horizontal movement of the dowel plate 14 within the interior cavity 20. Further, lateral movement of the dowel plate 14 may collapse the spacing chamber 24 if the distance of the lateral movement is beyond an elastic movement threshold provided by the material of the spacing element 22 and corresponding configuration of the spacing chamber 24.

Figure 7A:
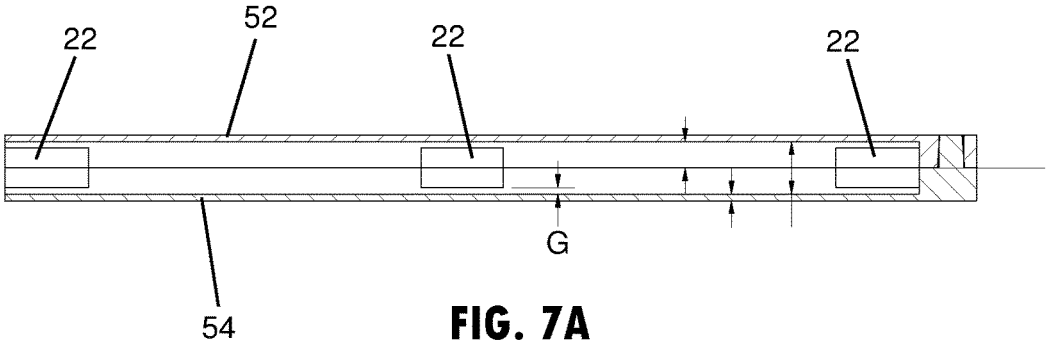
FIG. 7A is a cross-sectional view of the floor dowel sleeve taken at line A-A of FIG. 7, showing the spacing elements in the interior cavity.
Figure 7B:
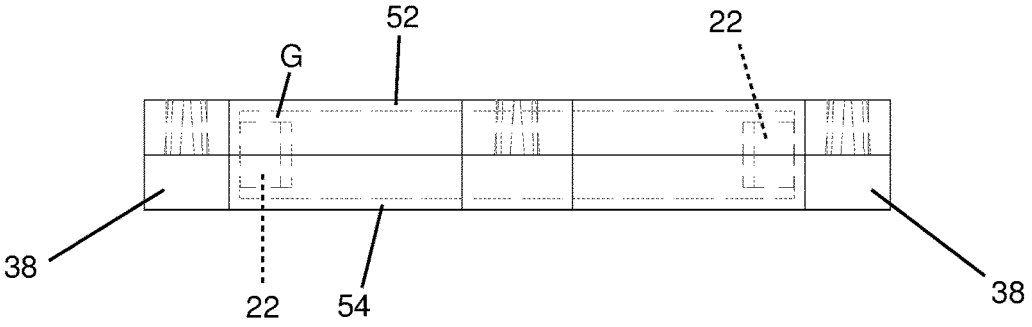
FIG. 7B is a cross-sectional view of the floor dowel sleeve taken at line B-B of FIG. 7, showing the spacing elements in the interior cavity in dashed lines.

As further shown in FIG. 7, the legs 58 of each of the spacing elements 22 may angle toward each other, such as at an angle 62 of approximately 40 degrees, and interconnect at the apex portion 60 of the respective spacing element 22. The angle of the legs may vary in alternative examples of the spacing element, such as between 20 and 70 degrees. The apex portions 60 of the spacing elements 22 contact the edges of the dowel plate 14 and may include a rounded or curved contact surface. A lateral distance D between the apex portions 60 of spacing elements 22 at the opposing side walls 44*a*, 44*b* is configured to be substantially equal to or less than a width of the dowel plate 14 between the opposing edges, such that move. Also, as shown in FIGS. 7A and 7B, the upper and lower edges of the spacing elements 22 may not engage the top and bottom walls 52, 54, such as to provide a gap G, which more easily allows the apex portion 60 of the spacing element 22 to compress into the spacing chamber 24. It is also contemplated that in additional embodiments that the upper and lower edges of the spacing elements may be engaged with the top and bottom walls of the sleeve, and may also include a weakened portion at the connection to allow the weakened portion to break upon lateral movement of the dowel plate 14.

Figure 9:
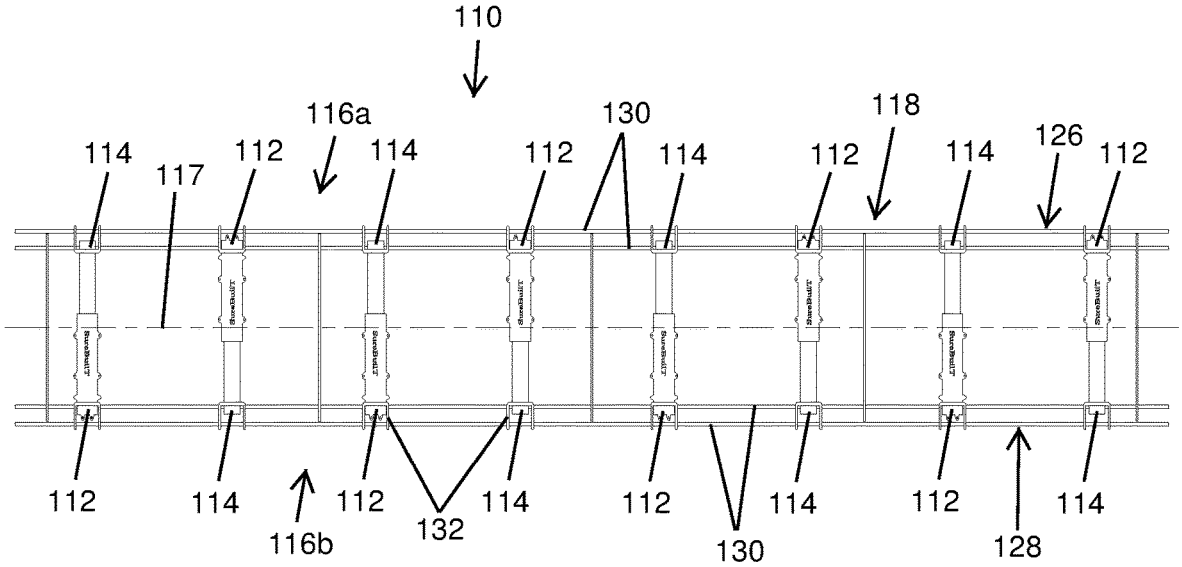
FIG. 9 is a top plan view of the floor dowel sleeves and reinforcement structure cast between two concrete slabs shown in FIG. 8.
Figure 10:
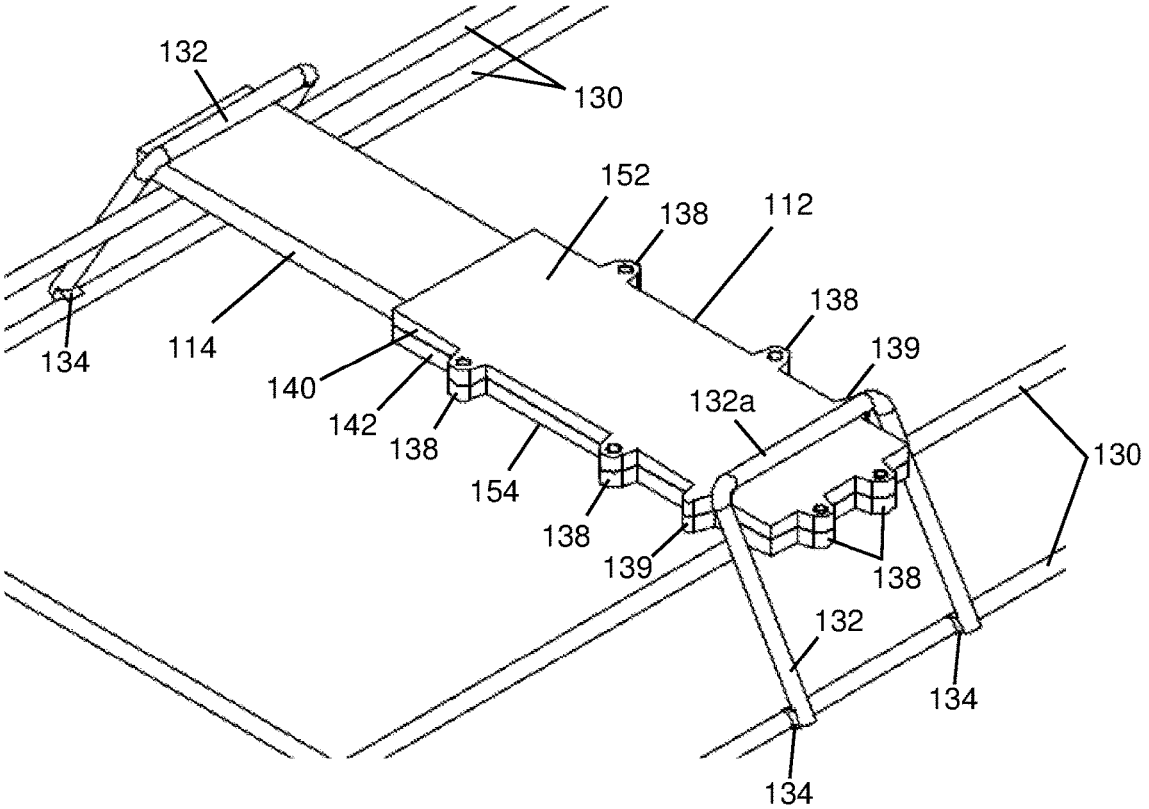
FIG. 10 is an enlarged view of a floor dowel sleeve shown in FIG. 8, taken at taken at section X.

Referring now to FIGS. 8-10, a floor dowel sleeve assembly 110 has eight floor dowel sleeves 112 that each receives a dowel plate 114. Similar to the assembly 10 shown in FIG. 1, the dowel plates 114 are arranged to span between and vertically support adjacent concrete slabs 116*a*, 116*b* at a seam 117 (FIG. 9) between the adjacent concrete slabs 116*a*, 116*b* to generally maintain a vertically flush seam or desired level between the slabs. As shown in FIGS. 8-9, the dowel sleeves 112 and plates 114 may be held in a reinforcement structure 118 that is disposed at and straddling the seam 117 when the adjacent concrete slabs 116*a*, 116*b* are cast, such as to allow the slabs to be poured at the same or nearly the same time. The reinforcement structure 118 that supports the sleeves 112 and dowel plates 114 away from the floor of the concrete form, as shown in FIGS. 8 and 9, includes two reinforcement sections 126, 128 that are arranged on opposing sides of the seam 117 and are substantially mirror images of each other across the seam 117. The reinforcement sections 126, 128 includes elongated wires or bars 130 that extend generally parallel to the seam 117 and risers 132 that extend upward from the floor of the concrete form to support the sleeves 112 and dowel plates 114 at an elevation desired for the cast concrete floor structure.

To support and horizontally suspended the sleeves 112 and dowel plates 114 in a freestanding manner prior to pouring the concrete, the risers 132 may extend or angle toward the seam 117 at a desired angle, such as between 50 and 70 degrees or approximately 60 degrees. The risers 132, as shown in FIG. 10, have a hook or horseshoe shape to provide an opening between the upper bar 130 and an upper section 132*a* of the riser 132. The sleeve 112 shown in FIGS. 8-11 also include a laterally extending pin or protrusion 139 near the end of the sleeve 112 to assist with assembling the sleeve 112 in the reinforcement structure 118 and prevent the sleeve 112 from moving horizontally through in the wire hook or riser 132. The protrusions 139 are located on the sleeve 112 to interface with the upper portion 132*a* of the riser 132 and thereby locate the riser 122 at a designated horizontal position relative to the reinforcement structure 118. When the sleeves 112, as shown in FIGS. 8 and 9, are placed in alternating directions in successive attachment locations on the reinforcement structure 118, the protrusions 139 on the sleeves 112 also act to control the spacing between the elongated wires or bars 130 in the opposing reinforcement sections 126, 128.

The reinforcement structure 118 may also include electric resistance weldments 134 that are attached between portions of the reinforcement structure 118 and connections between the reinforcement structure 118 and the dowel plates 114. The electric resistance weldments 134 may space pieces made of metal away from each other, such as at every wire intersection, such that the resistance weldments 134 may comprise electrically insulating material, such as a fiber glass or polymer or the like. As shown in FIG. 10, the resistance weldments 134 may provide a space between the dowel plates 114 and the elongated bars 130 and between the risers 134 and the elongated bars 130.

Figure 11:
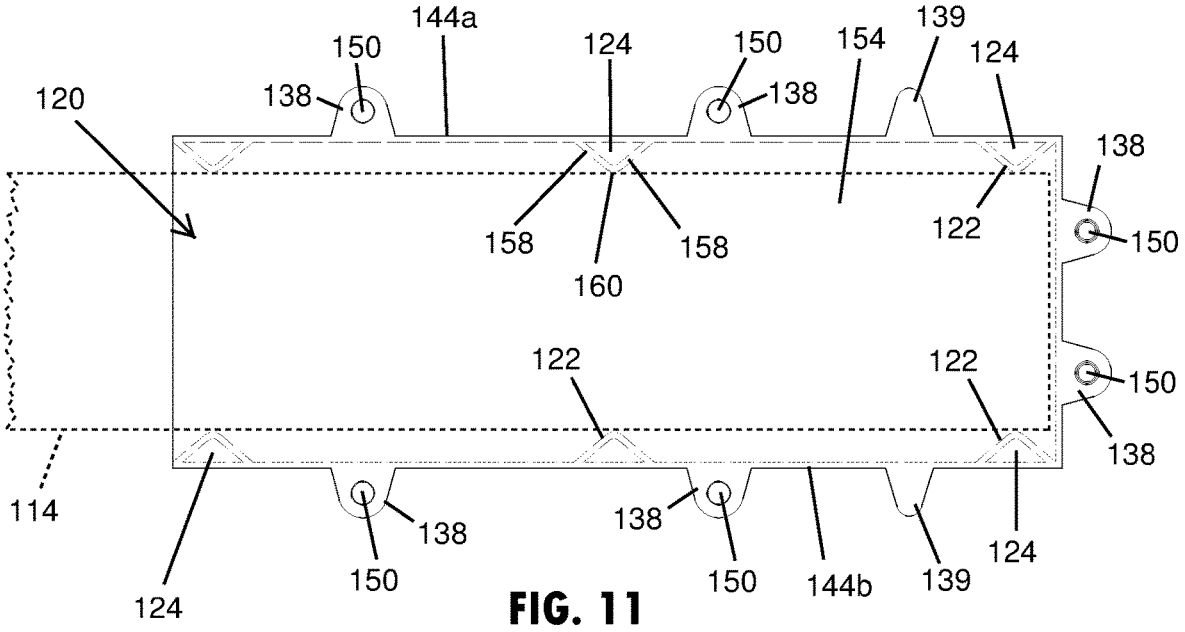
FIG. 11 is a plan view of the floor dowel sleeve shown in FIG. 10, showing the dowel plate and spacing elements in dashed lines.

The floor dowel sleeve 112, as shown in FIGS. 10 and 11, includes a body portion that has exterior retention elements 138, such as tabs that engage in and retain the sleeve 112 in the cast concrete slab. As shown in FIG. 11, the exterior retention elements 138 and the protrusions 139 are integral portions of the body portion of the dowel sleeve 112. The retention elements 138 protrude horizontally outward from the side walls 144*a*, 144*b* and the end wall 146 of the sleeve 112. As shown in FIG. 10, the sleeve 112 includes two pieces 140, 142 that attach together to form the sleeve 112, where both pieces of the sleeve 112 have the integrally formed exterior retention elements 138 and the protrusions 139, along with the integrally formed interior spacing elements 122 as a single piece. The two pieces of the sleeve 112 are injection molded from a plastic material; although it is contemplated that they may be made of one or more materials, such as at least one of a polymer, fiber composite, and metal material.

It is to be understood that the specific devices and processes illustrated in the attached drawings, and described in this specification are simply exemplary embodiments of the inventive concepts defined in the appended claims. Hence, specific values and other precise physical characteristics relating to the embodiments disclosed herein are not to be considered as limiting, unless the claims expressly state otherwise.

Changes and modifications in the specifically described embodiments may be carried out without departing from the principles of the present disclosure, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A floor dowel sleeve for receiving a dowel plate that spans across a seam between concrete slabs, said floor dowel sleeve comprising:

a body portion having a top wall, a bottom wall, two side walls, and an end wall that together to surround an interior cavity that is configured to receive a dowel plate at an opening in the body portion opposite the end wall, wherein the body portion comprises an upper piece having the top wall and a lower piece having the bottom wall that attach together at respective edges that divide the side walls and the end wall along a common horizontal plane;

a plurality of spacing elements disposed at each of the two side walls and configured to interface with opposing edges of the dowel plate to provide a space between the opposing edges of the dowel plate and interior surfaces of the two side walls;

wherein the plurality of spacing elements each comprise a pair of legs that integrally protrude at an angle toward each other from the interior surface of one of the two side walls into the interior cavity and interconnect at an apex portion of the respective spacing element to form a triangular shape with the side wall and a spacing chamber between the pair of legs and the interior surface of the side wall;

wherein the plurality of spacing elements are each divided along the common horizontal plane that separates the upper and lower pieces of the body portion to have an upper portion and a lower portion that each have a respective section of the spacing chamber; and wherein upper and lower edges of the plurality of spacing elements do not contact the corresponding top and bottom walls of the body portion to provide gaps therebetween for the upper and lower edges of the plurality of spacing elements to flex relative to the respective top and bottom walls into the spacing chamber upon lateral horizontal movement of the dowel plate within the interior cavity.

2. The floor dowel sleeve of claim 1, wherein the apex portions of the plurality of spacing elements comprises a tip having a rounded contact surface that interfaces with the dowel plate.

3. The floor dowel sleeve of claim 2, wherein the apex portions of the plurality of spacing elements are configured to contact the edges of the dowel plate.

4. The floor dowel sleeve of claim 2, wherein a lateral distance between the apex portions of the plurality of spacing elements at one of the opposing side walls and the apex portions of the plurality of spacing elements at the other one of the opposing side walls is configured to be substantially equal to a width of the dowel plate between the opposing edges.

5. The floor dowel sleeve of claim 1, wherein the upper and lower portions of the plurality of spacing elements engage along the common horizontal plane that separates the upper and lower pieces of the body portion.

6. The floor dowel sleeve of claim 1, wherein the pair of legs have a constant thickness and the spacing chamber formed by the pair of legs and the interior surface of the side wall has a triangular prism shape.

7. The floor dowel sleeve of claim 1, wherein the plurality of spacing elements each protrude laterally into the interior cavity at an equal spacing distance.

8. The floor dowel sleeve of claim 1, wherein the top and bottom pieces of the body portion configured to attach together prior to being cast in one of the concrete slabs.

9. The floor dowel sleeve of claim 8, wherein the top piece includes an upper retention element and the bottom piece includes a lower retention element that each protrude horizontally outward from the respective side walls, and wherein the upper and lower retention elements vertically align and matably engage each other to connect the top and bottom pieces.

10. A floor dowel sleeve assembly that spans between and vertically supports concrete slabs at a seam between the concrete slabs, said floor dowel sleeve assembly comprising:

a rectangular-shaped dowel plate having a first portion configure to be cast into a first concrete slab;

a rectangular-shaped sleeve having top wall, a bottom wall, two side walls, and an end wall that together surround a cavity that has an opening at an end opposing the end wall, wherein the sleeve is configured to be cast into a second concrete slab adjacent to and forming a seam with the first concrete slab;

wherein a second portion of the dowel plate is disposed in the cavity of the sleeve and interfaces with a plurality of spacing elements that protrude into the cavity from the two side walls to provide a space between the dowel plate and interior surfaces of the two side walls wherein the sleeve comprises an upper piece having the top wall and a lower piece having the bottom wall that attach together at respective edges that divide the side walls and the end wall along a common horizontal plane;

wherein the plurality of spacing elements each comprise a pair of legs that integrally protrude at an angle toward each other from the interior surface of one of the two side walls into the interior cavity and interconnect at an apex portion of the respective spacing element to form a triangular shape with the side wall and a spacing chamber that is disposed between the pair of legs and the interior surface of the corresponding side wall;

wherein the pair of legs are operable to flex into the spacing chamber upon lateral movement of the dowel plate; and wherein the plurality of spacing elements are each divided along the common horizontal plane that separates the upper and lower pieces of the body portion to have an upper portion and a lower portion that each have a respective section of the spacing chamber.

11. The floor dowel sleeve assembly of claim 10, wherein the apex portions of the plurality of spacing elements comprises a rounded tip that interfaces with the dowel plate.

12. The floor dowel sleeve assembly of claim 11, wherein the apex portions of the plurality of spacing elements are configured to contact planar longitudinal edges of the dowel plate.

13. The floor dowel sleeve assembly of claim 12, wherein a lateral distance between the apex portions of the plurality of spacing elements at one of the opposing side walls and the apex portions of the plurality of spacing elements at the other one of the opposing side walls is equal to a width of the dowel plate between the planar longitudinal edges of the dowel plate.

14. The floor dowel sleeve assembly of claim 11, wherein the pair of legs have a constant thickness and the spacing chamber formed by the pair of legs and the interior surface of the side wall has a triangular prism shape.

15. The floor dowel sleeve assembly of claim 11, wherein the top and bottom pieces of the rectangular-shaped sleeve are configured to attach together prior to being cast in one of the concrete slabs.

16. The floor dowel sleeve assembly of claim 11, wherein the two side walls are substantially parallel with each other and substantially perpendicular with the top wall and the bottom wall of the body portion.

17. The floor dowel sleeve assembly of claim 10, wherein the upper and lower portions of the plurality of spacing elements contact along the common horizontal plane that separates the upper and lower pieces of the body portion.

18. The floor dowel sleeve assembly of claim 10, wherein the plurality of spacing elements each protrude laterally into the interior cavity an equal spacing distance to provide the space between the dowel plate and interior surfaces of the two opposing walls an equal distance along the length of the dowel plate.

* * * * *